US006523714B2

(12) United States Patent
Serbiak

(10) Patent No.: US 6,523,714 B2
(45) Date of Patent: Feb. 25, 2003

(54) CONTAINER HAVING VIRUCIDAL, BACTERIAL, AND/OR GERMICIDAL PROPERTIES

(75) Inventor: Anna Maria Serbiak, Morrisville, PA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/965,118

(22) Filed: Sep. 27, 2001

(65) Prior Publication Data

US 2002/0043537 A1 Apr. 18, 2002

Related U.S. Application Data

(60) Provisional application No. 60/237,845, filed on Oct. 3, 2000.

(51) Int. Cl.[7] ..... A47K 10/24
(52) U.S. Cl. ..... 221/45; 221/135
(58) Field of Search ..... 221/33, 45, 46, 221/48, 49, 56, 135; 424/409, 412

(56) References Cited

U.S. PATENT DOCUMENTS

| | | | |
|---|---|---|---|
| 3,369,698 | A | 2/1968 | Scholz |
| 3,369,699 | A | 2/1968 | Enloe et al. |
| 4,411,374 | A | 10/1983 | Hotchkiss |
| 4,513,862 | A | 4/1985 | Mallow |
| 4,533,435 | A | 8/1985 | Intili |
| 4,681,739 | A | 7/1987 | Rosenblatt et al. |
| 4,689,169 | A | 8/1987 | Mason et al. |
| 4,828,912 | A | 5/1989 | Hossain et al. |
| 4,888,175 | A | 12/1989 | Burton, Jr. et al. |
| 5,011,602 | A | 4/1991 | Totani, et al. |
| 5,126,070 | A | 6/1992 | Leifheit et al. |
| 5,227,168 | A | 7/1993 | Chvapil et al. |
| 5,334,388 | A | 8/1994 | Hoang et al. |
| 5,407,685 | A | 4/1995 | Malchesky et al. |
| 5,486,381 | A | 1/1996 | Cleveland et al. |
| 5,631,300 | A | 5/1997 | Wellinghoff |
| 5,639,295 | A | 6/1997 | Wellinghoff et al. |
| 5,650,446 | A | 7/1997 | Wellinghoff et al. |
| 5,668,185 | A | 9/1997 | Wellinghoff |
| 5,686,089 | A | 11/1997 | Mitra et al. |
| 5,687,875 | A | 11/1997 | Watts et al. |
| 5,740,913 | A | 4/1998 | McFarland |
| 5,837,274 | A | 11/1998 | Schick |
| 5,871,763 | A | 2/1999 | Luu et al. |
| 5,900,383 | A | 5/1999 | Davis et al. |
| 5,919,554 | A | 7/1999 | Watterson, III et al. |

FOREIGN PATENT DOCUMENTS

| | | |
|---|---|---|
| JP | 1257124 A | 10/1989 |
| JP | 10259325 | 9/1998 |

*Primary Examiner*—Kenneth W. Noland
(74) *Attorney, Agent, or Firm*—Dority & Manning, P.A.

(57) ABSTRACT

A tissue dispenser having virucidal, bacterial, and/or germicidal properties is provided. The tissue dispenser includes a carton adapted to contain tissues having a plurality of walls and a carton opening. The carton can be made from numerous materials, including cardboard, paperboard, or plastic materials. Various anti-microbial agents known in the art can also be applied the exterior surface of the tissue dispenser to impart virucidal, bacterial, and/or germicidal properties thereto. The anti-microbial agent can comprise up to 100% of the surface area of the exterior surface of the dispenser, and in some embodiments, between about 10% to about 80%.

25 Claims, 2 Drawing Sheets

CONTAINER HAVING VIRUCIDAL, BACTERIAL, AND/OR GERMICIDAL PROPERTIES

RELATED APPLICATIONS

The present application claims priority to a provisional application filed on Oct. 3, 2000 having Ser. No. 60/237,845.

BACKGROUND OF THE INVENTION

Disposable tissues, such as facial tissues or wipes, are used by numerous individuals for wiping noses, faces, hands, and the like. For instance, individuals with colds or other various sicknesses often find these tissues extremely useful. In fact, a sick person can use up a number of facial tissues within a relatively short period of time.

In order to store and dispense such disposable tissues, various types of containers have been introduced in the past. For example, cardboard boxes (or cartons) are one example of a container conventionally used to dispense facial tissues. Such boxes or cartons are usually placed in bathrooms or other similar areas so that the tissues can be easily accessed when needed. Normally, the tissues are interfolded within these tissue containers or dispensers so that one tissue can be removed at a time by a particular individual. To best remove each tissue, it is often common for an individual to place his or her hand on the dispenser, while simultaneously pulling a tissue from the dispenser.

However, because tissues are often used by sick persons, various viruses, bacteria, yeast, fungi and other microorganisms can often transfer from the sick person's hands or the tissue used by such person to the tissue dispenser when retrieval of the tissue from the dispenser is attempted. Moreover, because tissue containers are typically kept in warm, humid areas, such as bathrooms, germs can often grow and thrive on the tissue dispenser, even without substantial human contact. As a result, persons using a tissue dispenser having various microorganisms located thereon can often become infected with the particular microorganism and become sick.

As such, a need currently exists for a tissue dispenser that can help prevent the spread of disease. In particular, a need exists for a tissue dispenser that is formed such that the growth of various viruses, bacteria, yeasts, fungi, and other microorganisms on the exterior surface of the dispenser is substantially inhibited.

SUMMARY OF THE INVENTION

The present invention is directed to a tissue dispenser that is capable of storing and dispensing various types of tissues, such as facial tissues. In one embodiment, at least one surface of the tissue dispenser is treated with an anti-microbial agent such that the surface can inhibit the growth of viruses, bacteria, fungi, yeasts, and various other microorganisms.

In accordance with the present invention, a tissue dispenser is provided that stores and dispenses tissues. Any commonly used tissue dispenser can be used in the present invention. For instance, the tissue dispenser can have a variety of shapes and sizes, and can be made from a variety of materials. In one embodiment, a tissue dispenser of the present invention includes a carton having a bottom wall, a top wall, and at least four side walls. The top wall of the carton can include a dispensing slot or opening through which a tissue can be threaded. In some embodiments, a plastic film can also overlay the carton opening to protect the tissues within the carton and provide sufficient resistance to prevent multiple tissue dispensing. To remove a tissue from a tissue dispenser of the present invention, a user desirably places his or her hand on the carton itself, while simultaneously pulling a lead tissue through the carton opening.

Tissue dispensers of the present invention, such as described herein, can generally be made from a variety of materials. In one embodiment, the tissue dispenser can be made from cardboard or paperboard. In another embodiment, the tissue dispenser can be made from a plastic material, such as polyethylene. When made from a plastic material, a tissue dispenser of the present invention can also be formed into a portable dispenser, such as a soft or rigid plastic pouch.

In accordance with the present invention, a tissue dispenser of the present invention is generally treated with an anti-microbial agent to provide virucidal, bacterial, and/or germicidal properties. In general, the anti-microbial agent of the present invention can be any material commonly used in the art to kill microorganisms. For example, in one embodiment, the anti-microbial agent comprises aqueous or resinous triclosan. In another embodiment, a carboxylic acid is utilized as the anti-microbial agent. In still another embodiment, zeolite complexes, such as silver zeolite, are used.

The anti-microbial agent can be applied to a tissue dispenser of the present invention according to any process known to those skilled in the art. Examples of such application methods include spray, print, blade, spray-drying, foam, or brush applications. The anti-microbial agent can also be saturated onto or impregnated into the tissue dispenser during or after formation of the dispenser. In some embodiments, the anti-microbial agent can be contained within a coating composition and applied to the tissue dispenser. For instance, suitable coating compositions can include, but are not limited to, aqueous or ultraviolet curable coatings, microcrystalline wax coatings, polyethylene coatings, acrylic polymer coatings, and the like.

In general, the anti-microbial agent can be applied in any amount to cover up to 100% of the exterior surface of a tissue dispenser of the present invention. In some embodiments, the anti-microbial agent can be applied in an amount to cover between about 10% to about 80% of the surface area of the exterior surface of the tissue dispenser. It should be understood, however, that the anti-microbial agent can also be applied to the interior surface of a tissue dispenser of the present invention if desired. Moreover, in some embodiments, the anti-microbial agent can also be applied to the plastic film overlaying the carton opening.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
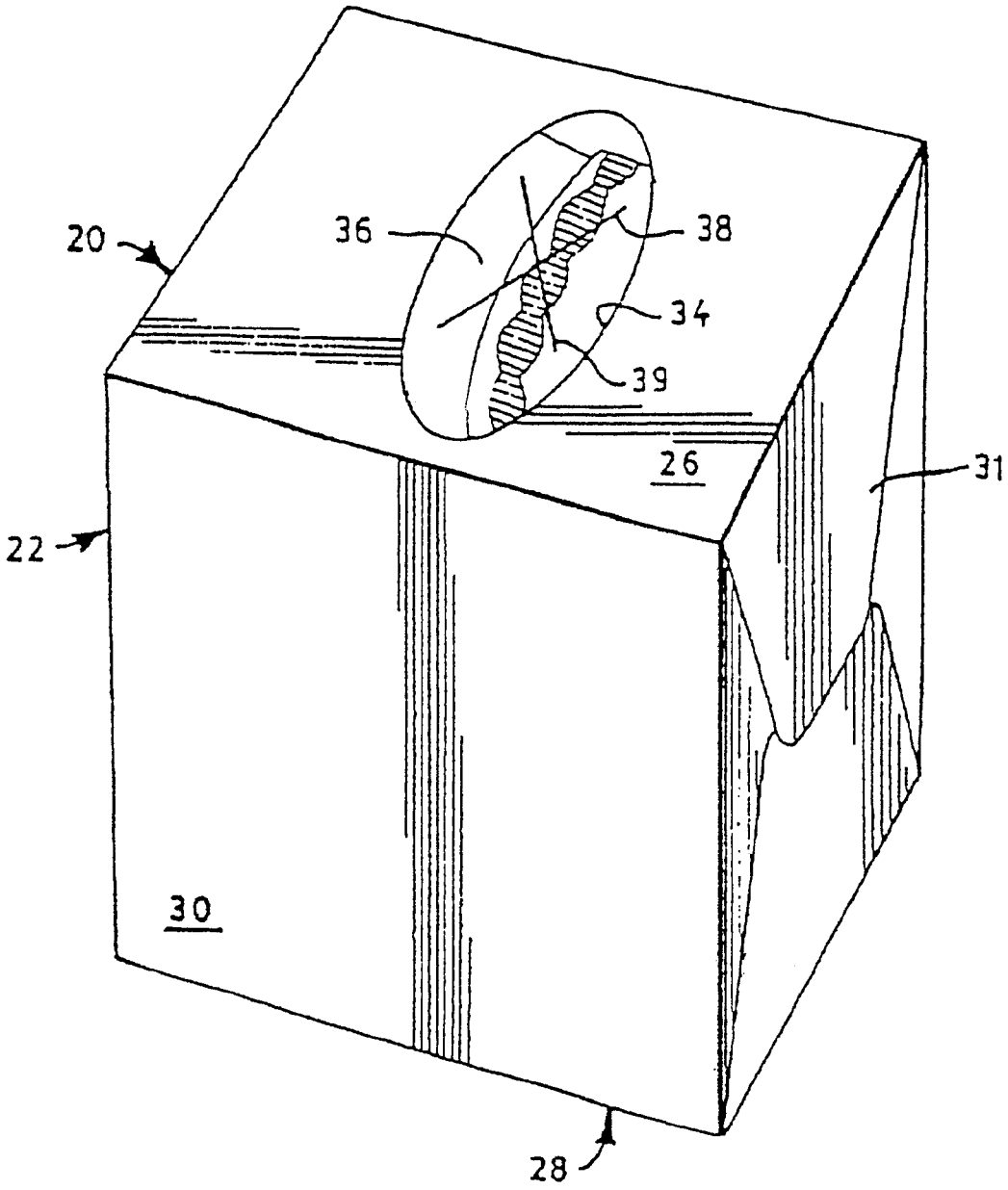
FIG. 1 is a perspective view of a tissue dispenser containing tissues according to one embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a tissue dispenser that can effectively inhibit the transfer of various viruses, bacteria, yeast, fungi, and other microorganisms. In particular, the present invention is directed to a tissue dispenser treated with an anti-microbial agent such that a dispenser having bacterial, virucidal, and/or other germicidal properties can result. It has been discovered that a dispenser of the present invention can inhibit the formation of various germs thereon, even when tissues within the dispenser are used over an extended period of time. A tissue dispenser of the present invention can generally be formed by any manner well known in the art. For example, in one embodiment, the tissue dispenser can be formed as a standard carton for housing facial tissues, such as disclosed in U.S. Pat. No. 3,369,698 to Scholz, which is incorporated herein in its entirety by reference thereto for all purposes. In particular, a standard cardboard container can be utilized having a pair of opposed side walls, a bottom wall, a pair of opposed end walls, and a top wall having a dispensing slot through which a leading edge of a tissue is threaded. The leading edge of the threaded tissue can be gripped and easily removed. Such a carton can contain various tissues, such as a clip or stack of interleaved, unconnected, multi-ply tissues arranged for sequential dispensing through the dispensing slot. Other examples of suitable tissue dispensers are disclosed in U.S. Pat. No. 3,369,699 to Enloe, et al; U.S. Pat. No. 4,513,862 to Mallow; and U.S. Pat. No. 5,740,913 to McFarland, which are herein incorporated in their entirety by reference thereto for all purposes.

Referring to FIG. 1, one example of a tissue dispenser formed according to one embodiment of the present invention is shown. It should be understood, however, that the tissue dispenser described herein is but one example of a tissue dispenser that can be used in the present invention. Moreover, it should be also be understood that the present invention may be utilized to dispense other types of folded sheet products. Thus, the term "tissue" is not intended to be limited to facial tissues, but is used herein to include any individual sheet product, such as dry or moistened wipes, household or industrial wipes, soap or fabric softening sheets, or the like. In one embodiment, for instance, the tissue can be a unitary structure made up of at least two plies of thin, lightweight, absorbent, creped cellulosic sheet material such as disclosed in U.S. Pat. No. 3,369,698 to Scholz. In another embodiment, visually distinctive tissues can be utilized, such as disclosed in U.S. Pat. No. 5,740,913 to McFarland.

In this regard, a tissue dispenser is illustrated in FIG. 1 as an upright, facial tissue dispenser 20. The tissue dispenser 20 includes a carton 22 that is adapted to contain a clip of prefolded interfolded tissues disposed within the carton. Carton 22 is shown as a rectangular shaped box having a top wall 26, an opposite bottom wall 28, and four sidewalls extending between the top and bottom walls. The sidewalls that are fully visible in FIG. 1 have been given reference numerals 30 and 31. Carton 22 may be constructed in a variety of sizes and shapes as are well known in the art. For example, in one embodiment, carton 22 can include a single cylindrically-shaped sidewall extending between the top and bottom walls (not shown). Further, as illustrated in FIG. 1, any of the sidewalls, such as sidewall 31, may be constructed of one or more panels that are bonded together by adhesives, thermal bonds, or other suitable means.

The top wall 26 of carton 22 defines a carton opening 34 in the form of an aperture through which tissues may be individually removed from the carton. Carton 22 optionally includes a plastic film 36 overlaying the carton opening 34 and incorporating intersecting dispensing slits 38 and 39. The use of plastic film 36 is desirable, particularly for larger carton openings, in order to protect the tissues within the carton and provide sufficient resistance to prevent multiple tissue dispensing. Plastic film 36 may be bonded to the top wall 26 by adhesives or other suitable means, and the dispensing slits 38 and 39 may assume other forms such as a single slit, an aperture or the like. Carton 22 may also be provided with a removable panel (not shown) that creates the carton opening when the panel is removed.

Figure 2:
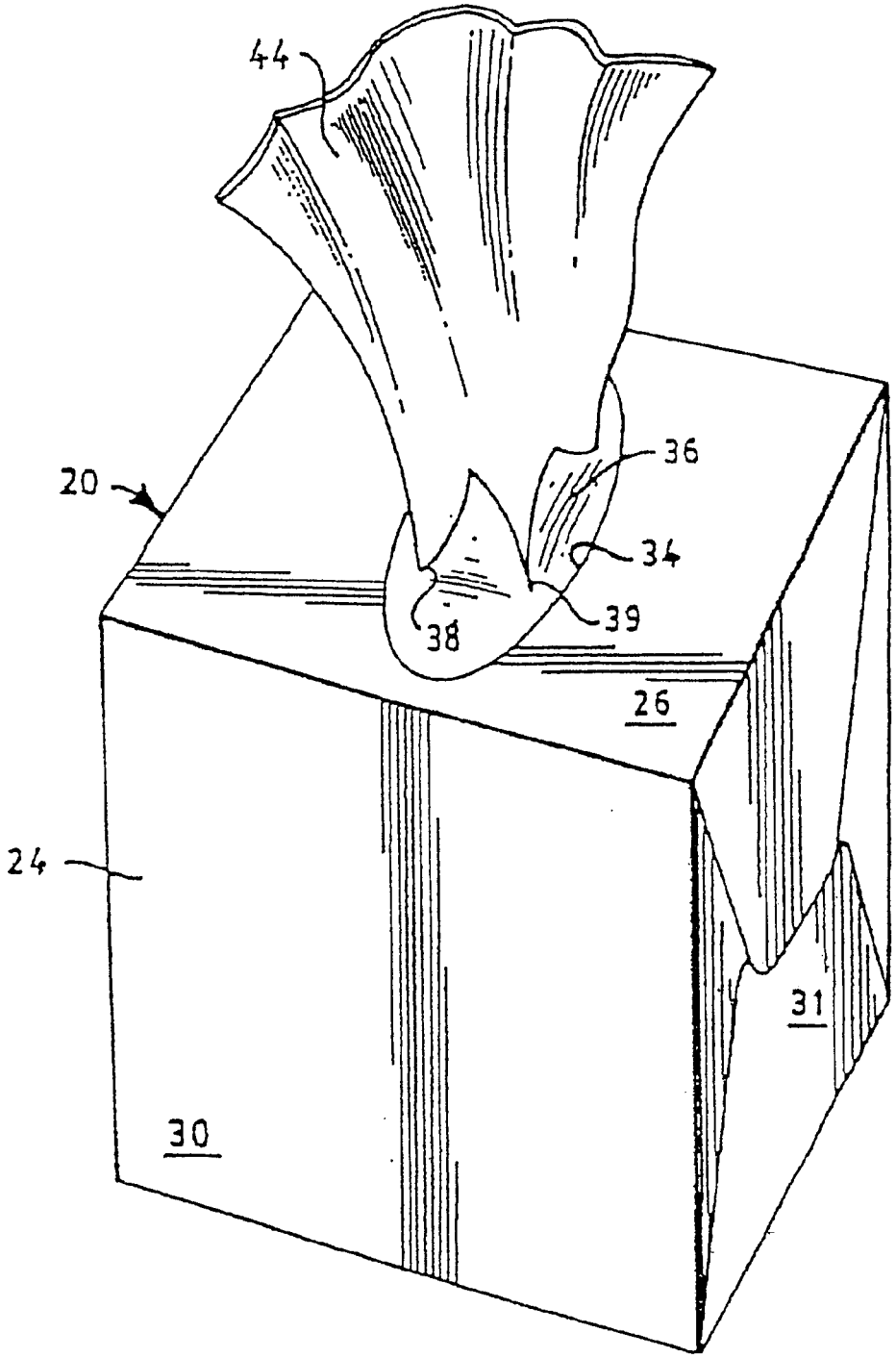
FIG. 2 is the tissue dispenser of FIG. 1, with the first tissue having been partially removed therefrom.

As stated, a tissue dispenser of the present invention is generally configured to house various types of tissues. For example, an individual clip of prefolded interfolded tissues can be included within a tissue dispenser of the present invention. The clip can comprise a series of tissues beginning with a first tissue and also including a plurality of other, underlying tissues. For instance, referring to FIG. 2, a first tissue 44 is depicted. First tissue 44 is the first tissue of a clip of interfolded tissues having a plurality of other underlying tissues (not shown). To remove a tissue, a user typically grasps tissue 44 from carton 22, while simultaneously placing his or her hand on carton 22. As the tissue 44 is removed, a second tissue (not shown) is pulled through the dispensing slits 38 and 39 as a result of interfolding of the tissues. As illustrated in FIG. 2, first tissue 44 is shown as being positioned for use and held in place by plastic film 36. It will be appreciated as well by those skilled in the art that the top dispensing fold configuration could include two, three or more tissues, instead of just one as illustrated. Alternatively, the tissues can be non-interfolded and releasably attached to one another sufficiently to enable dispensing. Moreover, the tissues can be made from the same or different materials in essentially the same configuration. The composition of the tissues will depend upon their intended function, as is well known to those skilled in the art.

In general, carton 22 can be made from a variety of materials commonly used in the art to produce tissue dispensers. Such materials can include, but are not limited to, cardboard, paperboard, plastic, and the like. In one embodiment, the tissue dispenser can be a portable, plastic dispenser (not shown) made from various plastic materials, such as polyolefins (e.g. polyethylene) and the like. Such portable dispensers are described in U.S. Pat. No. 5,687,875 to Watts, et al., which is herein incorporated in its entirety by reference thereto for all purposes.

In accordance with the present invention, the tissue dispenser also generally contains an anti-microbial agent. By containing an anti-microbial agent, a tissue dispenser of the present invention can inhibit the promulgation of various viruses, bacteria, yeast, fungi, or other microorganisms. In particular, when an individual utilizes a tissue, such as a facial tissue, the individual's hands or the tissue used by the individual can often contact the tissue dispenser, thereby transferring various germs to the dispenser. However, an anti-microbial treated tissue dispenser of the present invention can kill microorganisms or germs that contact the surface of the dispenser and, thus, prevent the further transfer of the germs to a subsequent user.

An anti-microbial agent applied to a tissue dispenser of the present invention can generally comprise a number of different chemicals or additives commonly used as disinfectants in the field. For example, one embodiment of the present invention includes a chlorine dioxide-generating formulation containing chlorine dioxide, sodium chlorate surfactant, and an acid moiety as the anti-microbial agent. A commercially available example of such a time-release chlorine dioxide formulation is made by Bernard Technologies, Inc. and sold under the name "MICROSPHERE 2500" and which may be described in U.S. Pat. Nos. 5,631,300; 5,639,295; 5,650,446; and 5,668,185. Other examples of systems that can be used to generate chlorine dioxide, for instance, are disclosed in U.S. Pat. Nos. 4,681,739; 4,689,169; 5,126,070; 5,227,168; and 5,407,685, which are incorporated herein in their entirety by reference thereto for all purposes.

In one embodiment of the present invention, the anti-microbial agent can include silver ions. In certain embodiments, a silver-zeolite complex can be utilized to provide controlled release of the anti-microbial agent. One commercially available example of such a time-release anti-microbial agent is sold as a fabric by HEALTH SHIELD under the name GUARDTEX, and is constructed from polyester and rayon and contains a silver-zeolite complex. Other suitable silver-containing microbial agents are disclosed in Japanese Unexamined Patent No. JP 10/259325, which is incorporated herein in its entirety by reference thereto for all purposes. Moreover, in addition to silver-zeolites, other metal-containing inorganic additives can also be used in the present invention. Examples of such additives include, but are not limited to, copper, zinc, mercury, antimony, lead, bismuth, cadmium, chromium, thallium, or other various additives, such as disclosed in Japanese Patent No. JP 1257124 A and U.S. Pat. No. 5,011,602 to Totani, et al., which are herein incorporated in their entirety by reference thereto for all purposes. In some embodiments, the activity of the additive can also be increased, such as described in U.S. Pat. No. 5,900,383 to Davis, et al., which is also herein incorporated in its entirety by reference thereto for all purposes.

In still another embodiment of the present invention, calcium hypochlorite particles may comprise the anti-microbial agent. An example of a commercially available form of calcium hypochlorite particles suitable for use in the present invention is ALDRICH-brand #24-415-5 stabilized technical grade (ground and screened to approximately 150 micron particle size). In some embodiments, the anti-microbial agent can be polymerized, encapsulated to enhance the ability to control the amount of anti-microbial agent released over an extended period of time.

Other anti-microbial agents can also be utilized in a tissue dispenser made in accordance with the present invention. Examples of such anti-microbial agents can include, but are not limited to, quaternary amines, halogens, chlorine dioxide, silver ions, or combinations thereof. Another anti-microbial agent that could be employed is disclosed in U.S. Pat. No. 5,837,274 to Shick, et al., which is incorporated herein in its entirety by reference thereto for all purposes.

In addition to the anti-microbial agents mentioned above, still other anti-microbial agents can be applied to a tissue dispenser in accordance with the present invention. For example, liquid quats, such as alkyl aryl benzalkonium chloride, or other materials such as aqueous or resinous triclosan, can be utilized. One commercially available example of such an anti-microbial agent suitable for use in the present invention is a resinous form of triclosan distributed by The Microban Products Company of Huntersville, N.C., and sold under the name "MICROBAN", which may be disclosed in U.S. Pat. No. 4,533,435 to Intili or U.S. Pat. No. 5,919,554 and Watterson Ill, et al., which are incorporated herein in their entirety by reference thereto for all purposes.

Various other anti-microbial agents known in the art can also be utilized. For instance, other suitable anti-microbial agents, such as carboxylic acids, are disclosed in U.S. Pat. No. 4,828,912 to Hossain, et al., which is incorporated herein in its entirety by reference thereto for all purposes. Still other suitable antimicrobial agents can include any of the various materials disclosed in U.S. Pat. No. 4,888,175 to Burton, Jr., et al., which is incorporated herein in its entirety by reference thereto for all purposes.

Other anti-microbial agents may also be utilized in the present invention. For instance, some other suitable antimicrobial agents that can be used in the present invention include, but are not limited to, chlorohexidine gluconate; parachlorometaxylenol (PCMX); benzylthoneium chloride; chitosan, such as chitosan pyrrolidone carboxylate; etc. Still other suitable antimicrobial agents are described in U.S. Pat. No. 5,871,763 to Luu, et al., U.S. Pat. No. 5,334,388 to Hoang, et al., and U.S. Pat. No. 5,686,089 to Mitra, et al., which are incorporated herein in their entirety by reference thereto for all purposes.

It should be understood that the tissue dispenser of the present invention can be treated with a single anti-microbial agent or with a combination of anti-microbial agents. For instance, in one embodiment, two or more of the above-identified anti-microbial agents can be applied to the tissue dispenser in order to provide the dispenser with activity against a broad range of microorganisms.

Besides anti-microbial agents, it may often be useful to add various other additives to the tissue dispenser. In general, any additive known in the art can be applied to a tissue dispenser of the present invention. For example, plasticizers, composite particles, stabilizers, surfactants, porous absorbents, binders, adhesives, dyes, etc., can be applied to a tissue dispenser of the present invention.

In general, anti-microbial agents and/or other additives can be applied to a tissue dispenser of the present invention in a number of ways. In one embodiment, the anti-microbial agent(s) and/or other additives can be printed onto the tissue dispenser. In other embodiments, the anti-microbial agent(s) and/or additives can be applied by blade, spray, spray-drying, foam, or brush applications, as are well known in the art. Furthermore, in another embodiment, the anti-microbial agent(s) and/or other additives can be applied to the dispenser using a saturant system, such as disclosed in U.S. Pat. No. 5,486,381 to Cleveland, et al., which is herein incorporated in its entirety by reference thereto for all purposes. Additionally, in still another embodiment, the anti-microbial agent(s) and/or additives can be impregnated into the material during the paper-making process, such as disclosed in, for example, U.S. Pat. No. 4,533,435 to Intili. Moreover, the antimicrobial agent(s) and/or additives can also be applied to the tissue dispenser in the form of a thin film or sheet, such as disclosed in U.S. Pat. No. 4,888,175 to Burton, Jr., et al.

Furthermore, in some embodiments, the anti-microbial agent(s) and/or other additives can be incorporated into various coating compositions that are then applied to the tissue dispenser. For example, in one embodiment, a resinous form of triclosan, such as "MICROBAN", can be incorporated into aqueous and ultraviolet curable coatings that are then applied to a tissue dispenser of the present invention. Commercially available examples of such antibacterial aqueous and ultraviolet curable coatings are obtainable from Cork Industries, Inc., located in Folcroft, Pa. In another embodiment, the tissue dispenser can be treated with a durable coating containing one or more carboxylic acids, such as described in U.S. Pat. No. 4,828,912 to Hossain, et al. Another coating can include, in one embodiment, an aqueous emulsion of an acrylic polymer. In another embodiment, a microcrystalline wax coating may be employed. In yet another embodiment, polyethylene can be used. For instance, in various embodiments, a 20% acrylic polymer coating, a 33.5% acrylic polymer coating, or a 60% microcrystalline wax coating may be used. The use of a coating, such as described above, in conjunction with various anti-microbial agents and other additives can allow such materials to remain on a tissue dispenser of the present invention for an extended period of time without being easily wiped off or removed.

In order to sufficiently provide a tissue dispenser of the present invention with virucidal, bacterial, and/or germicidal properties, it is typically desired that a substantial portion of the exterior surface of the tissue dispenser be treated with the anti-microbial agent(s). For instance, in one embodiment, the anti-microbial agent(s) and/or other additives can generally be applied to the tissue dispenser in a pattern that covers up to 100%, and in some embodiments between about 10% to about 80% of the exterior surface area of the tissue dispenser. It should be understood that the antibacterial agent(s) can also be applied to the interior surface of the tissue dispenser if desired. Moreover, in one embodiment, as indicated above and illustrated in FIG. 1, the tissue dispenser 20 can include a plastic film 36 overlaying the carton opening 34 and incorporating intersecting dispensing slits 38 and 39. If desired, plastic film 36 can also be treated with the anti-microbial agent(s) and/or other additives in accordance with the present invention to further inhibit the spread of disease.

Although various embodiments of the invention have been described using specific terms, devices, and methods, such description is for illustrative purposes only. The words used are words of description rather than of limitation. It is to be understood that changes and variations may be made by those of ordinary skill in the art without departing from the spirit or scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A tissue dispenser comprising:

a carton adapted to contain tissues comprising a plurality of walls defining therein a carton opening, said carton having an exterior surface and an interior surface; and an anti-microbial agent applied to at least a portion of said exterior surface of said carton, said anti-microbial agent being capable of inhibiting the growth of microorganisms on said portion of said exterior surface applied thereto.

2. A tissue dispenser as defined in claim 1, wherein said anti-microbial agent comprises triclosan.

3. A tissue dispenser as defined in claim 2, wherein said anti-microbial agent comprises a resinous form of triclosan.

4. A tissue dispenser as defined in claim 2, wherein said anti-microbial agent comprises an aqueous form of triclosan.

5. A tissue dispenser as defined in claim 1, wherein said anti-microbial agent comprises a carboxylic acid.

6. A tissue dispenser as defined in claim 1, further comprising a plastic film formed of a transparent material overlaying said carton opening and defining therein a dispensing slit.

7. A tissue dispenser as defined in claim 6, wherein said anti-microbial agent is further applied to at least a portion of said plastic film.

8. A tissue dispenser as defined in claim 1, wherein said carton is formed from a cardboard material.

9. A tissue dispenser as defined in claim 1, wherein said carton is formed from a plastic material.

10. A tissue dispenser as defined in claim 1, wherein said anti-microbial agent is applied to about 10% to about 80% of the area of said exterior surface of said carton.

11. A tissue dispenser as defined in claim 1, wherein said anti-microbial agent is contained within a coating composition applied to said dispenser.

12. A tissue dispenser comprising:

a rectangular-shaped carton adapted to contain a clip of tissues, said carton comprising a top wall, a bottom wall, and at least four side walls, said walls defining a carton opening along said top wall, said carton having an exterior surface and an interior surface; and an anti-microbial agent covering up to 100% of the surface area of said exterior surface of said carton, said anti-microbial agent being capable of inhibiting the growth of microorganisms on said portion of said exterior surface applied therewith, said microorganisms being selected from the group consisting of viruses, bacteria, fungi, and yeasts.

13. A tissue dispenser as defined in claim 12, wherein said anti-microbial agent comprises triclosan.

14. A tissue dispenser as defined in claim 13, wherein said anti-microbial agent comprises a resinous form of triclosan.

15. A tissue dispenser as defined in claim 13, wherein said anti-microbial agent comprises an aqueous form of triclosan.

16. A tissue dispenser as defined in claim 12, wherein said anti-microbial agent comprises a carboxylic acid.

17. A tissue dispenser as defined in claim 12, further comprising a plastic film formed of a transparent material overlaying said carton opening and defining therein a dispensing slit.

18. A tissue dispenser as defined in claim 17, wherein said anti-microbial agent is further applied to at least a portion of said plastic film.

19. A tissue dispenser as defined in claim 12, wherein said carton is formed from a cardboard material.

20. A tissue dispenser as defined in claim 12, wherein said carton is formed from a plastic material.

21. A tissue dispenser as defined in claim 12, wherein said anti-microbial agent is applied to about 10% to about 80% of the area of said exterior surface of said carton.

22. A tissue dispenser as defined in claim 12, wherein said anti-microbial agent is contained within a coating composition applied to said dispenser.

23. A method of forming a tissue dispenser having virucidal, bacterial, or germicidal properties, said method comprising the steps of:

providing a carton adapted to contain tissues and having a plurality of walls, said walls defining therein a carton opening, said carton having an exterior surface and an interior surface; and applying an anti-microbial agent to at least a portion of said exterior surface of said carton, said anti-microbial agent being capable of inhibiting the growth of micro-organisms on said portion of said exterior surface applied therewith.

24. A method as defined in claim 23, wherein said anti-microbial agent is printed onto said carton.

25. A method as defined in claim 23, wherein said anti-microbial agent is sprayed onto said carton.

* * * * *